United States Patent [19]

Buchhorn

[11] 4,271,653

[45] Jun. 9, 1981

[54] CLADDING SHEETS

[75] Inventor: Peter Buchhorn, Cardiff, Australia

[73] Assignee: John Lysaght (Australia) Limited, Sydney, Australia

[21] Appl. No.: 70,016

[22] Filed: Aug. 27, 1979

[30] Foreign Application Priority Data

Oct. 26, 1978 [AU] Australia ..... PD6537

[51] Int. Cl.[3] ..... E04D 3/362; E04D 3/363

[52] U.S. Cl. ..... 52/522; 52/520; 52/553

[58] Field of Search ..... 52/520, 522, 553, 478

[56] References Cited

U.S. PATENT DOCUMENTS 2,765,887 10/1958 Horowitz ..... 52/520

3,775,922 12/1973 Myers ..... 52/520 X 3,982,373 9/1976 Wilson et al. ..... 52/522 X

FOREIGN PATENT DOCUMENTS 872817 7/1961 Australia ..... 52/522

*Primary Examiner*—Alfred C. Perham

*Attorney, Agent, or Firm*—Pearne, Gordon, Sessions, McCoy & Granger

[57] ABSTRACT

To ensure positive inter-engagement of the free edge of a male rib at one side of a roof or wall cladding sheet with an internal shoulder formed in, and longitudinally of, a female rib at one side of an identical sheet, the said free edge has a series of outwardly displaced abutments formed on it so that engagement between the two is confined to those points at which the abutments are placed.

1 Claim, 4 Drawing Figures

CLADDING SHEETS

This invention relates to roof or wall cladding sheets. These are more usually made of galvanished sheet steel of the kind (for example) marketed under the registered Trade Mark "LYSAGHT KLIP-LOK". Such cladding sheets have a longitudinally-shouldered female rib formation bordering one longitudinal edge of the sheet and a male rib formation bordering the other longitudinal edge. The male rib of one sheet is able to enter the female rib of another similar sheet, and when so entered the free edge of a flange forming part of the male rib lockingly engages over the shoulder of the female rib.

Examples of the prior art cladding sheets are fragmentarily illustrated, in cross-section, in FIG. 3 of the drawings herewith. There it will be seen that one sheet 5 is bordered along one longitudinal edge by a female rib formation 6 longitudinally shouldered at 7. The neighbouring cladding sheet 8 has a male rib formation 9 able to enter the female rib formation with the free edge 10 intended, in the main, lockingly to engage over the shoulder 7.

Still referring to FIG. 3, the illustrated portion of edge 10 is not in direct engagement with shoulder 7 because an ordinary fixing clip 11 has been applied to the inter-fitting rib formations to hold the sheets in relation to purlins or the like. The fixing clips are well spaced apart, at purlin spacing for example, and thus between the fixing clips the flange free edge 10 is able to engage directly with shoulder 7. This, of itself, is largely satisfactory in use because of the distance between any two fixing clips, the interlocking engagement is effectively secured directly between flange 10 and shoulder 7; and to assist in this, it is customary for the flange 13 to be rolled at a more obtuse angle relative to the remainder of the male rib than is shown in FIG. 3 so that in between fixing brackets the flange 13 is sufficiently outspread hopefully to engage the shoulder 7 in a snap-fitting manner. This, however, is not always easily accomplished because for its entire length between purlins the free edge 10 has to be sprung in to engage the shoulder 7.

For economy reasons, it is desirable to place purlins as far apart as possible compatible with the required strength of the structure as a whole. This means however, that in the centre regions between adjacent purlins substantial lengths of the cladding sheets are unsupported and therefore relatively springy. It is found under these circumstances that difficulty arises in affecting the required interlocking arrangement because hammer blows or the like applied to the cladding ribs can be insufficient to cause the entire length of shoulder 7 to deform and interlock with the flange edge 10 due to the male rib yieldingly receding under the blows.

The object of the present invention is to overcome the disabilities referred to above by the provision of a male rib formation in which interlocking engagement with the shoulder of a female rib is at specifically spaced apart points but of such certain frequency as to ensure that interlocking engagement is effectively established.

The invention provides a cladding sheet of the kind having a longitudinally-shouldered female rib formation bordering one longitudinal edge of the sheet and a male rib formation bordering the other longitudinal edge, the male rib of one sheet being designed to enter the female rib formation of another similar sheet with at least a part of the free edge of a flange forming part of said male rib lockingly engaging over the shoulder of the female rib; characterised in that said free edge has a series of spaced-apart outwardly displaced abutments formed on it to such effect that when a male rib is homed in a female rib the distal edges of the abutments engage said shoulder to the exclusion of the remainder of the flange from which the abutments are displaced.

An example of the invention is shown in FIGS. 1, 2 and 4 of the drawings herewith.

Figure 1:
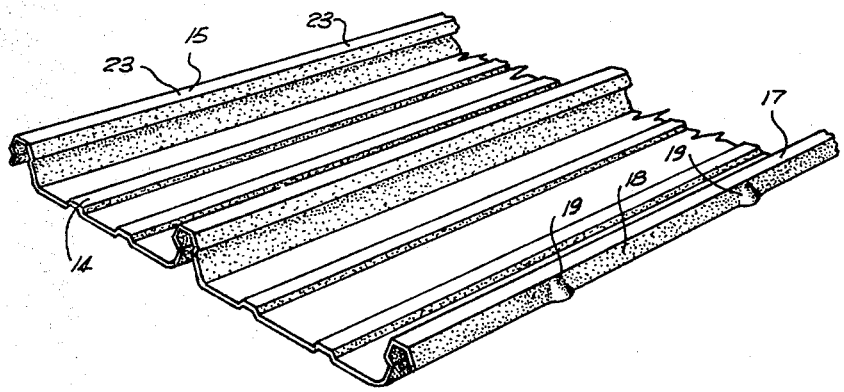
FIG. 1 is a partly-broken perspective view of a single cladding sheet.

A cladding sheet 14 has a female rib formation 15 which is longitudinally shouldered at 16. Sheet 14 also has a male rib formation 17 which includes flange 18. The free edge 18 includes a series of outwardly displaced abutments 19. Another similar sheet 20 also has a male rib formation 17A, flange 18A and a series of outwardly displaced abutments 19A as aforesaid.

Figure 2:
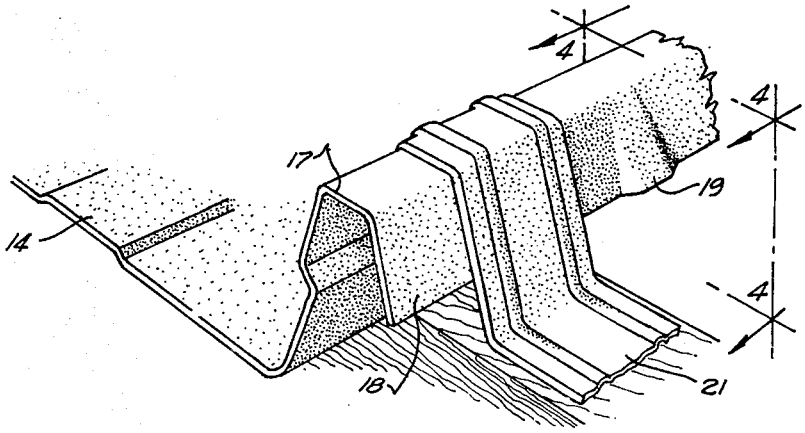
FIG. 2 is a fragmentary perspective view, on an enlarged scale, showing part of the male rib formation shown in FIG. 1 together with part of a fixing clip applied thereto.
Figure 3:
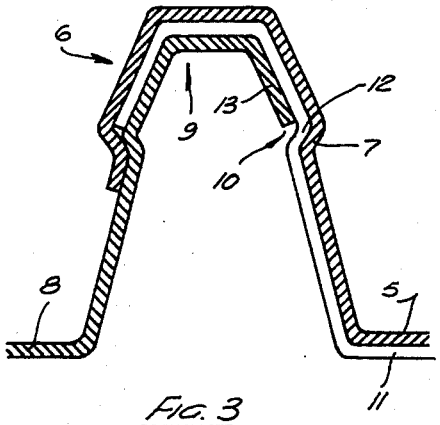
FIG. 3 PRIOR ART
Figure 4:
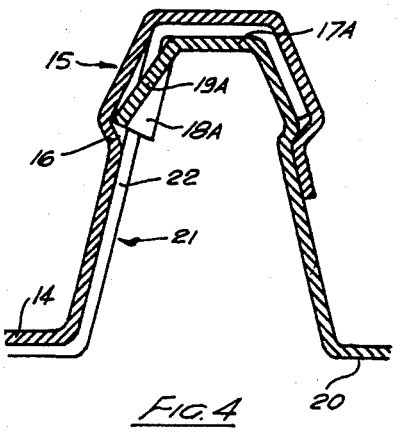
FIG. 4 shows the interlocking rib formations of two cladding sheets and may be regarded as a sectional end elevation taken substantially on the plane 4—4 indicated in FIG. 2.

The cladding as a whole may be secured to the purlins or the like by fixing clips 21 which are virtually the same as those shown in FIG. 3 except that there is no need for the fixing clip to be provided with a shoulder portion such as that marked 12 in FIG. 3. Instead, a corresponding portion 22 (FIG. 4) may be straight as it is a relatively simple matter to so position the cladding sheets relative to the fixing clips that the portion 22 is able to extend freely through the space between a mutually adjacent pair of abutments 19 as shown in FIGS. 2 and 4.

When the cladding sheets are being assembled together, only the small proportions of the flange 18 at and adjacent to abutments 19 has to spring inwardly to effect a locking action. Thus there is a substantial reduction in the amount of loading required to effect engagement. It would appear that because of the point-like concentration of the loading the level of interference can be increased at abutment 19 and that when engagement is effected, it is clearly signalled by the audible snap-fitting click which accompanies the engagement of abutment such as 19A with a shoulder such as 16.

I claim:

1. A cladding sheet of the kind having a longitudinally-shouldered female rib formation bordering one longitudinal edge of the sheet and a male rib formation bordering the other longitudinal edge, the male rib of one sheet being designed to enter the female rib formation of another similar sheet with at least a part of the free edge of a flange forming part of said male rib lockingly engaging over the shoulder of the female rib; characterised in that said free edge has a series of spaced-apart outwardly displaced abutments formed on it to such effect that when a male rib is homed in a female rib the distal edges of the abutments engage said shoulder to the exclusion of the remainder of the flange from which the abutments are displaced.

* * * * *